US005343876A

United States Patent [19]

Rogers

[11] Patent Number: 5,343,876

[45] Date of Patent: Sep. 6, 1994

[54] MODULAR PAD

[76] Inventor: John E. Rogers, P.O. Box 1437, Blue Jay, Calif. 92317

[21] Appl. No.: 775,832

[22] Filed: Oct. 15, 1991

Related U.S. Application Data

[63] Continuation-in-part of Ser. No. 324,442, Mar. 16, 1989, abandoned.

[51] Int. Cl.[5] ..... A61F 5/00

[52] U.S. Cl. ..... 128/870; 128/845

[58] Field of Search ..... 297/382, 452; 5/652, 5/653, 654, 455, 648; 128/845, 846, 869, 870

[56] References Cited

U.S. PATENT DOCUMENTS

| | | | |
|---|---|---|---|
| 2,855,986 | 10/1958 | Engelen, Sr. | 5/653 X |
| 2,962,086 | 11/1960 | Waltimyer | 5/431 |
| 3,112,956 | 12/1963 | Schick et al. | 297/382 |
| 3,158,878 | 12/1964 | Pernell | 5/431 |
| 3,222,694 | 12/1965 | Schick | 5/431 |
| 4,484,781 | 11/1984 | Phelps | 5/455 X |
| 4,488,332 | 12/1984 | Hunt et al. | 5/455 |
| 4,557,260 | 12/1985 | Reyes, Jr. | 128/869 |
| 4,673,216 | 6/1987 | Alfer | 5/653 X |
| 4,712,833 | 12/1987 | Swanson | 5/431 |
| 4,824,174 | 4/1989 | Dunn, Sr. | 5/653 X |
| 4,965,899 | 10/1990 | Sekido et al. | 5/455 X |

*Primary Examiner*—Robert A. Hafer
*Assistant Examiner*—Sam Rimell
*Attorney, Agent, or Firm*—Natan Epstein

[57] ABSTRACT

A portable patient supporting seat that is not only comfortable but also controls the spine support by correct pelvis positioning. Ischial turerosity (protuberances) support the users body while sitting and elevate the anus from the seated height. A first advantage of the present invention that is a modular pad, is to provide a build up that assists the body in supporting the anus externally and relieving the load on the sphincter muscle. By varying the configuration and modifying the dimensions relief of the ischial tuberosity and coccyx pressure is achieved. Adding a back support to the present invention allows better support for some patients suffering low back pain as well as providing a support insert that may be used in wheel-chairs as well as in automobiles. The modular structure of the present invention is to provide configuration components that are interchangeable, yet each configuration being self contained.

7 Claims, 4 Drawing Sheets

MODULAR PAD

This is a continuation-in-part of co-pending application Ser. No. 07/324,442 filed on 03/16/89, now abandoned.

SUMMARY OF THE INVENTION

The basic modular pad comprises two laterally spaced femoral support blocks mounted on a rigid or flexible base board, which blocks are of such dimensions that the buttocks of the user are supported above the base board. The base board and blocks may be integral or formed from separate components, and may be of irregular shape if desired. The basic modular pad may be modified by use of insert components to control anal pressure.

Patients suffering from enervation (lack of feeling) may be subject to tissue death by excessive pressure and/or shear being applied over bony protuberances while seated which may be relieved by the present invention. An abduction wedge may also be used therewith to control leg separation. The components of the invention may be fabricated from polyurethane, polyethylene, neoprene or the like or other suitable material that will provide adequate patient support and flexibility.

The support blocks may be hollow resilient bodies that expand and contract in height as pressurized fluid is discharged therein or allowed to discharge therefrom. Pressure sensitive switches that are normally open may be mounted on the base board to complete an electrical circuit and signal either visually or audibly that the hollow resilient bodies are under inflated for proper support of the patient.

In those situations where correct pressure relief is only attainable by correct angle relationship of the trunk relative to the femar, a back support may be secured to the base board, with the angle of the back support being variable and adjustable to suit a particular patient. This concept is particularly useful in automobiles, stadiums, wheel chairs and the like. The invention may by the use of a second angled base board be adapted to support a patient in a car having a downwardly and rearwardly tapering seat.

From the above summary it will be seen that the major object of the invention is to provide a modular pad of simple structure that is comfortable to use and is adapted to control both spinal and pelvic positions of the user.

BRIEF DESCRIPTION OF THE DRAWINGS

FIGS. 17 and 19 are plan views and FIG. 18 a perspective view of alternate hollow resilient blocks that are filled with a gel and that may be used as cushions for a patient to sit on;

DESCRIPTION OF THE PREFERRED EMBODIMENTS

Figure 1:
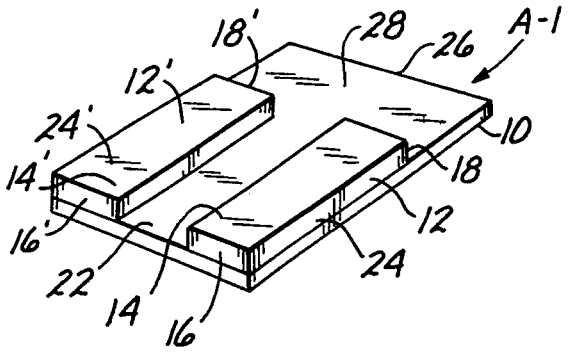
FIG. 1 is a perspective view of a first form of the modular pad.

FIG. 1 is a perspective view of a first form A-1 of the modular pad in which it will be seen to include a base board 10 that is illustrated as being rectangular, although other shapes may be used if desired. The base board 10 serves as a mounting for a pair of laterally spaced generally parallel, femoral support blocks 12 and 12' that are preferably substantially rigid, but may be inflatable.

The base board 10 and the pair of femoral support blocks 12 and 12' may be molded as an integral unit from rubber, fiberglass, thermoplastic resins or the like at the option of the manufacturer.

Figure 27:
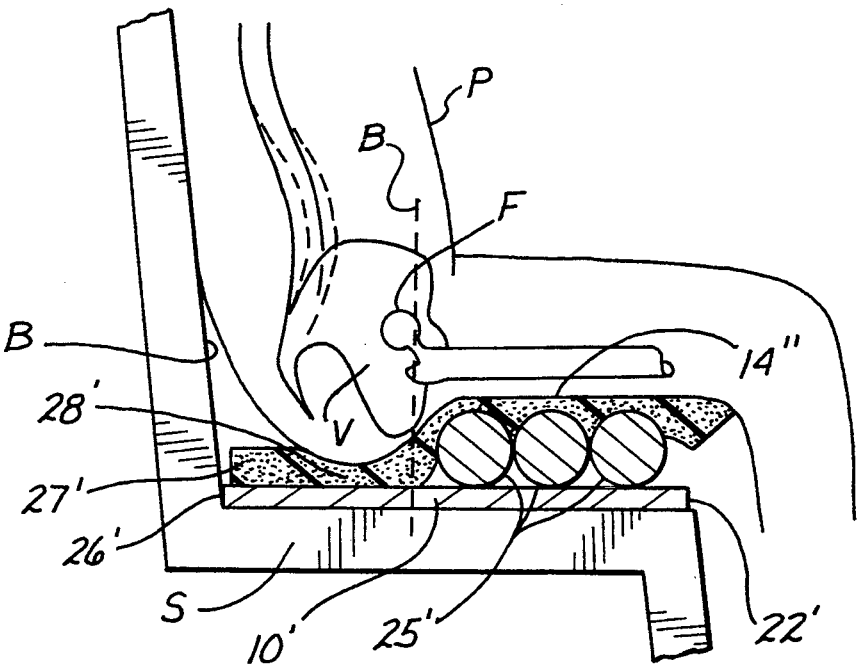
FIG. 27 is an elevational cross section of an alternate form of the pad according to this invention, illustrating the effect on pelvic support of a person seated thereon.

FIG. 27 better illustrates the corrective action exerted by the novel pad, in its basic form equivalent to that shown in FIG. 1, on the pelvis of a person seated with the pad 10' placed on a seat S underneath a user P. The primed numerals in FIG. 27 correspond or are equivalent to elements indicated by unprimed numerals in FIG. 1. The support pad has a base board 10' which is of generally rectangular shape as shown in FIG. 1, analogous to the base board 10 in FIG. 1. The rear end 26' of the base board is oriented towards and placed against the back rest B of the seat S, while the front end 22' of the base board is near the front edge of the seat S. The pad includes a femoral support which is comprised collectively of three cylindrical elements 25' parallel to each other and attached to the top surface of the base board 10' transversely to the board, i.e. parallel to the front and rear ends of the board and fully extending between two side edges of the base board. Further the three support elements 25' are near the front end 22' of the base board, the diameter of the rear most cylinder 25' terminating at its rear most end at about the mid point of the base board between the front and rear ends of the base board. Consequently, a bare 28' of the base board between the rear most cylinder 25' and the rear end 26' is devoid of the femoral support elements. An optional sheet of relatively soft, resilient synthetic foam 27' covers the rear area 28' of the base board and also the three cylinders 25' constituting the femoral support.

The three cylinders 25' together define an elevated support plane which is tangential to the tops of the cylinders and generally parallel to the base board 10'. The cylinders 25' are preferably cylindrical inflatable chambers pressurized to a substantial degree of stiffness so as to support the size of the patient P as shown in FIG. 27, spaced several inches above the top surface of the base board 10'. The base board 10' and the support elements 25' are dimensioned so as to provide a definite and steep transition from the elevated support plane to the top surface 25' of the base board at a point located just forwardly of the femoral head F of the patient P, as indicated by the vertical dotted line R in FIG. 27. The femoral head F is a pivot point for the pelvis V, which therefore tends to drop down towards the base board surface 28', pivoting about the femoral head F in a counterclockwise direction in FIG. 27. In an individual who has poor spinal lower back posture, suggested by the parallel dotted lines in FIG. 27 in the lower back area, the rotation of the pelvis effectively repositions the spinal column to a more erect condition shown in solid lining in the drawing. The thick sheet of foam 27' is selected to provide a degree of comfort for the user P between the buttock and the base board surface 28', as well as to fill in the longitudinal voids defined between the cylinders 25'.

It is contemplated that the board 10' can be cut to a custom dimension for a particular user as well as for particular seat, to maintain proper positioning of the femoral supports 25' in relation to the users pelvis. Alternatively, standard sizes of the base board 10' in graded sizes, can also be provided. The femoral supports 25' may be of a variety of materials, so long as firm thigh support results. In the case of inflatable supports 25', it is possible to inflate the cylinders to variant degrees so as to elevate the thigh of a particular user to an optimum level above the base board 10', so as to achieve optimum pelvic repositioning and lower back posture correction.

Figure 8:
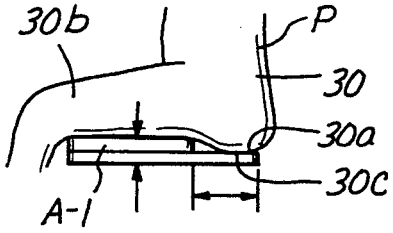
FIGS. 8, 9 and 10 are diagrammatic views of the first form of the invention.
Figure 9:
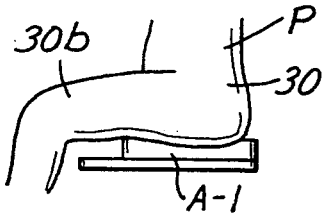

The supporting pad of FIG. 27 may be reversed on the seat S in the manner already described in connection with the pad of FIG. 1, and as illustrated in FIGS. 8 and 9. Specifically, the base board is reversed on the seats so that the front end 22' is now proximal to the back rest B of the seat, while the rear end 26' is now at the front of the seat. In such rearrangement, the buttock and pelvis V of the user P are elevated above the seat S and base board 10', while the front end of the thigh and knees of the subject are unsupported and thus tend to slope downwardly from the pelvis towards the knees. This causes an opposite displacement of the pelvis V, so that it rotates in a clockwise direction about the femoral head F, bringing about a corresponding repositioning of the spine which may be helpful to certain individuals.

The specific posture correction required by a particular subject depends on the individuals anatomy, different people finding relief from back pain in one position of the base board 10', while others find relief with the base board in the reverse position on the seat S.

The pair of femoral support blocks 12 and 12' have upper support surfaces 14 and 14', and forward and rearward end surfaces 16, 16' and 18, 18' respectively. The blocks 12 and 12' have inner side surfaces 20, 20' that cooperate to define a longitudinal space 22 therebetween that is situated above the base board 10, and the pair of blocks also having outer side surfaces 24, 24'. In some instances it may be desirable to have the side surfaces 20, 20' in abutting contact. The forward end surfaces 16, 16' are substantially flush with the forward end of the base board 10. The rearward end surfaces 18, 18' are situated forwardly a substantial distance from the rear edge surface 26 of base board 10. The base board 10 has an upper surface 28 that extends rearwardly from the pair of blocks 12, 12' to the rear edge 26.

Figure 10:
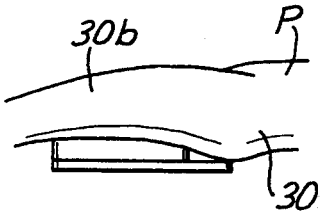
Figure 11:
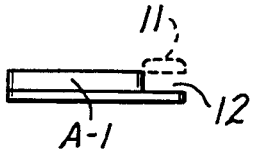
FIG. 11 is a side elevational view of the second form of the invention.
Figure 12:
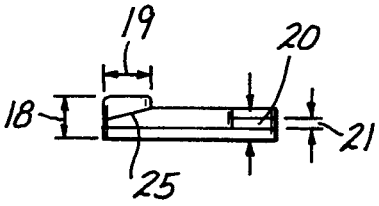
FIG. 12 is a side elevational view of the third form of the invention.

A patient P is shown in FIGS. 8, 9 and 10, which patient has a body 30 that includes buttocks **30*a* and legs 30*b*. The patient P also has an ischial tuberosity 30*c*. When the modular pad A-1 is used as shown in FIG. 8, the height of the side surfaces 12, 12' of the blocks is critical, for the blocks must be of sufficient height as to support the buttocks 30*a* of the patient P above the upper surface 28 of the base board 10**.

The length that the upper surface 28 extends rearwardly from the pair of blocks 12, 12' is important, for it must be of sufficient magnitude as to provide clearance for the buttocks **30*a*. In FIG. 9 the patient P is illustrated as resting on the modular pad A-1, but with the position of the pad reversed relative to that shown in FIG. 8 to tilt pelvis in opposite direction to that shown in FIG. 8**.

In FIG. 10 the form A-1 of the modular pad is serving as a part of a bed in which the patient lays in a supine position with the buttocks **30*a* rearwardly of the femoral support blocks 12, 12'. In the three positions for the patient P as shown in FIGS. 8, 9 and 10 the body 30 of the patient is held in a different pelvic rotation. If desired, the pair of femoral blocks 12, 12'** may be coated or covered with a soft somewhat resilient sheet material or envelope (not shown) that imparts a more desirable feel to the blocks. Also, free upper surfaces of the base may support a soft or forgiving material (not shown).

Figure 2:
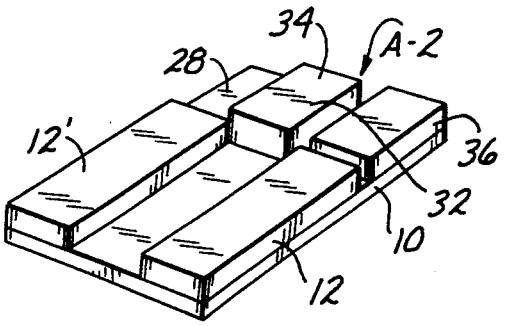
FIG. 2 is a perspective view of a second form of the modular pad that differs from the first form by including an insert by which the pressure on the anus of the patient may be controlled.

The second form A-2 of the invention as shown in FIG. 2 is particularly adapted for use by patients P suffering from emmorhoidal and pirineum stitch problems. The second form A-2 of the modular pad includes all of the elements of the first form A-1 but in addition includes a first rectangular or suitable shaped insert 32 mounted on the upper surface 28 of the base board 10 and is centrally disposed thereon and extends rearwardly from the blocks 12, 12' and is axially aligned with the space 22.

The second form A-2 may also include a pair of second inserts 36 that are mounted on the upper surface 28 of the base board 10 and situated on each side of the first insert 32. Only one of the second inserts 36 is shown in FIG. 2. By varying the height of the first and second inserts 32 and 36 relative to one another the pressure on the anus of the patient P may be controlled. The sides of the insert may be shaped to present a more narrow surface to the anus area to increase and control pressure on the affected site.

The upper forward portion of the first insert 32 if desired may be tapered forwardly and downwardly to reduce testicular pressure and perineum pressure on the patient. The inserts 32 and 36 are preferably removably secured to the surface 28 of the base board 10 by "VELCRO" or other suitable fastening material. It will be apparent that perineum pressure may be relieved completely on the part of the patient P by removal of the first insert 32 from the base board 10.

Figure 3:
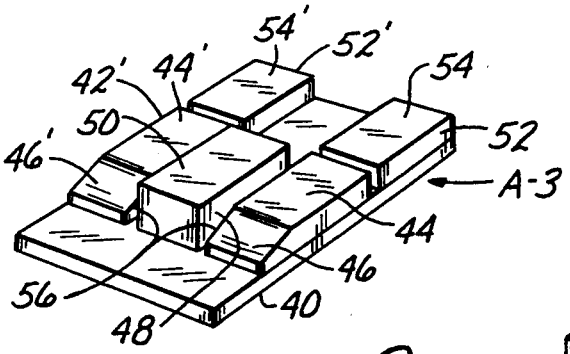
FIG. 3 is a perspective view of a third form of the modular pad.

Patients P suffering from enervation, (lack of feeling) may be subject to tissue death by excessive pressure being applied over boney prominences while the patient is seated. Accordingly this form A-3 of the modular pad shown in FIG. 3 provides pressure relief over the ischial tuberosities, coccyx, and greater trochanter, as well as by separation, perineal relief, and reduction of shear forces to the skin. In FIG. 3 it will be seen that the third form A-3 of the invention includes a rectangular base board 40 that has a pair of laterally spaced pair of femoral support blocks 42, 42' that may be flexible or rigid mounted on the upper surface of the base board. The pair of blocks 42, 42' have flat upper surfaces 44, 44' that on the forward edge develop into forwardly and downwardly extending surfaces 46, 46'. The pair of blocks 42, 42' may be placed in abutting contact. Insert 48 of generally rectangular shape is centrally and removably disposed on the upper surface of the base board 40, preferably by "VELCRO" or other suitable means, and is illustrated as longitudinally aligned with the space between the pair of support blocks 42, 42' and extending upwardly thereabove. The form A-3 if desired may be an integral unit.

A pair of rear inserts 52, 52' are fixed or removably secured to the upper surface of the base board 40 by suitable means, with the rear inserts having flat or shaped upper surfaces 54, 54'. The forward insert 48 serves as an abduction wedge to keep the legs **30*b* of the patient P separated. The longitudinally extending space 56 if desired may be filled with graduated or other padding to control the pressure exerted on the patient P when resting on the third form A-3 of the modular pad. The base board 40 as well as the pair of blocks 42, 42', and the forward insert 48, as well as the rearward insert 52, 52'**, may be fabricated from polyethelene, polyurethane neoprene, or other type of somewhat resilient material that will give adequate patient support.

It is desirable that the components described in conjunction with the third form A-3 of the modular support be removably secured to one another, to permit either a modular support A-3 in standard sizes to be provided or to provide customized modular supports in which the dimensions of the various components of the third form A-3 are assembled to conform to the physical needs of the patient P.

Figure 4:
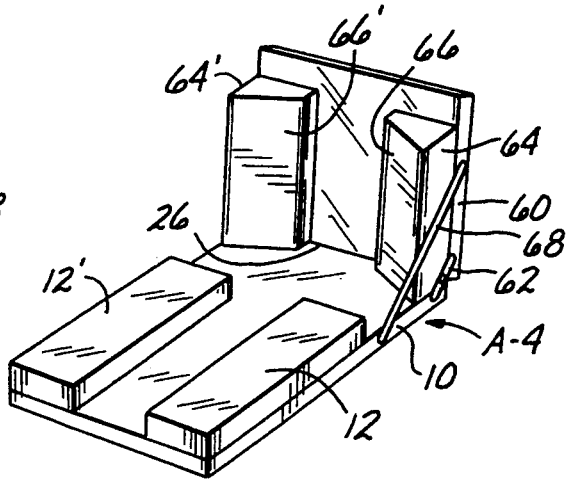
FIG. 4 is a perspective view of a fourth form of the modular pad.

The fourth form of the invention A-4 as shown in FIG. 4 includes all of the elements common to the first form A-1 but in addition includes a back support 60 that is preferably pivotally connected to the rearward edge 26 of the base board 10 by suitable hinges of pivotal connections 62. For convenience, both support and seat may be separate components, however, if modular seat and back are to be used in a fabric support it is possible that the base 40 and 60 are one continuous flexible surface and which all blocks are appropriately attached. In this instance blocks 12, 12' and 64' may be divided into sections to follow curved line of sling seat, base board 10 and 60.

A pair of laterally spaced, upwardly extending, elongate pads 64 and 64' are fixed or removably secured to the back board 60, and laterally separated from one another. The pad 64, 64' have forwardly disposed supporting surfaces 66, 66' that preferably taper rearwardly and inwardly towards one another to maintain the patient P in a centered position when resting on the femoral block 12, 12'.

A strap 68 is provided as shown in FIG. 4, that is removably connected to the base board 10 and back board 60, to support the back board in a desired angular relationship to the base board 10. The pads 64, 64', tend to support the patient P conformably on the fourth form A-4 of the modular support, and provide relief of boney spine or rotation of the part of the patient at the lumbar area. Surfaces 66 and 66' may be shaped to further support lumbar area of the body if desired or lumbar support may be laterally connected across back board 60 in lieu of either 64 or 64'. The fourth form A-4 of the modular support is adapted for use in automobiles, stadiums, in wheel-chairs, sling seat wheel-chairs or standard chairs.

Figure 5:
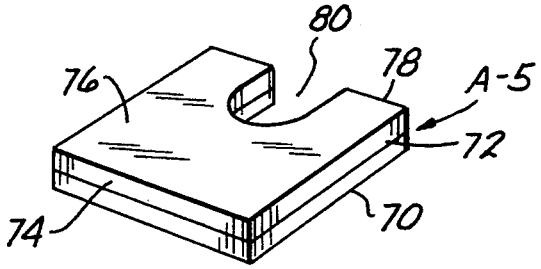
FIG. 5 is a perspective view of a fifth form of the modular pad.

If the height of the femoral support blocks 12, 12' is too high in the first form A-1 of the invention for ischial tuberosity pressure relief, a fifth form A-5 of the invention as shown in FIG. 5 may be utilized. The fifth form A-5 as may be seen in FIG. 5 includes a second base board 70 of substantially the same width as the base board 10, but with a cut-out. The second base board 70 supports a block 72 that has a forward transverse edge 74 and a flat upper surface 76.

The block 72 has a rear edge surface 78 from which a centrally disposed cut-out portion 80 extends forwardly. The form A-5 of the invention has the second base board support 70 replacing the base board 10, and with the pair of femoral support blocks 12, 12' resting and removably secured to the flat upper surface 76. Required thickness of block 72 and support 70 may be such that only one block shaped similarly to 72 is used to replace 10 of FIG. 1.

Figure 6:
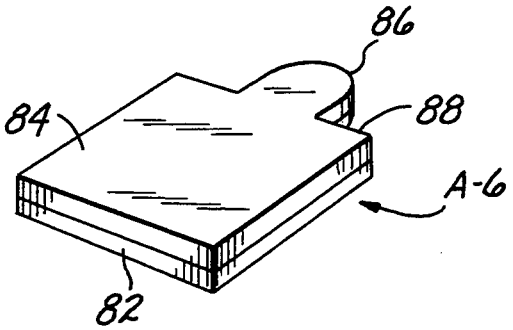
FIG. 6 is a perspective view of a sixth form of modular pad.

The second and third forms A-2 and A-3 of the modular pad may have a sixth form A-6 of the invention as shown in FIG. 6 used in conjunction therewith. The sixth form A-6 of the invention includes a second base board 82 that has a block 84 mounted thereon, with the block having a protuberance 86 projecting from the end edge 88 thereof. This also may be of such thickness as to replace 10 of FIG. 1.

Figure 7:
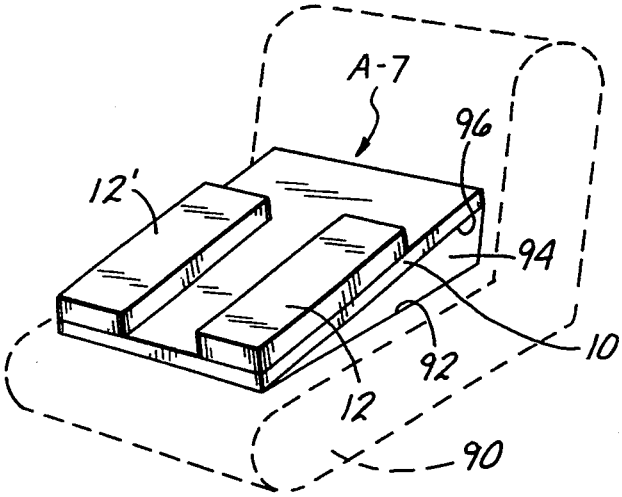
FIG. 7 is a perspective view of a seventh form of modular pad.

A seventh form A-7 of the invention is shown in FIG. 7 that is particularly adapted for use in an automobile that has a seat 90 that has a rearwardly and downwardly extending upper surface 92 that forms a part of the seat 90. The seventh form A-7 may include form A-1 through A-6, and in addition a wedge shaped body 94 that rests on the upper surface 92 of a reclined seat 90, with the upper surface 96 of the wedge shaped body 94 being substantially horizontal. The surface 96 has the base board 10 resting thereon, as a result the forms A-1 through A-6 of the invention that forms a part of the seventh forms A-7 are held in a stationary horizontal position. Even though the surface 92 of the seat 90 slopes downwardly and rearwardly, when the seventh form A-7 of the invention is used, the patient P is postured in the same manner as though he was resting on the first form A-1, which first form is in a substantially horizontal position.

Figure 13:
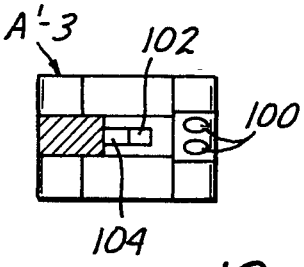
FIG. 13 is a top plan view of a modified form of the third form of the invention.
Figure 14:
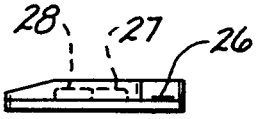
FIG. 14 is a longitudinal cross sectional view of the modified form of the third form of the invention.
Figure 15:
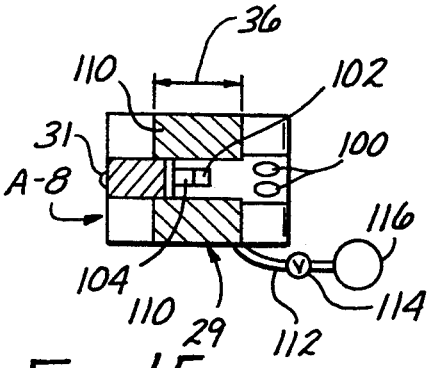
FIG. 15 is a top plan view of an eighth form of the invention.

FIGS. 13 and 14 illustrate a modified form A'-3 of the third form A-3 of the modular pad, and in this modified form the modified form A-3 includes a pressure sensitive transducer 100 that is preset to close at a specific pressure. The numeral 102 and 104 in FIG. 13 indicate a battery and a visual or audible alarm. The eighth form A-8 of the invention includes the elements of the third form A-3 arranged in the same manner as illustrated in FIG. 3, but in addition includes resilient hollow pads 110 mounted on the upper surfaces of the blocks 44 and 44'. Each of the pads has an air inlet to which a flexible tube 112 is connected that has a manually operable valve 114 connected to the outer end thereof. Each valve 114 has a resilient bulb 116 connected thereto.

The eighth form A-8 of the invention also includes pressure sensitive switches 100 and a battery 102 and alarm 104 that are operatively associated therewith. When the pressure sensitive switches are contacted by a portion of the patient P, the alarm 104 is actuated, which alarm may be visual or audible.

Upon the alarm being actuated, the valves 114 are in turn placed in open positions, and the bulbs 116 manually squeezed to further inflate the pads 110 and raise the patient P relative to the base board 40. When the patient P has been raised to a desired degree relative to the base board 40, the valves are placed in the closed positions. Elevation of the patient P as above described will be to the extent that the alarm 104 is not actuated.

Figure 16:
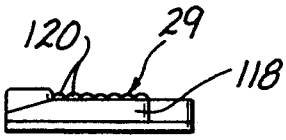
FIG. 16 is a side elevational view of the eighth form of the invention.

In FIG. 16 it will be seen that each pad 110 is formed from a pliable sheet material that has stitching 118 or other fastening means therein that provide a number of transverse, interiorly connected inflatable pockets 120.

Figure 17:
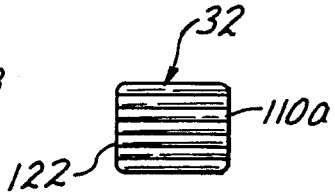
Figure 18:
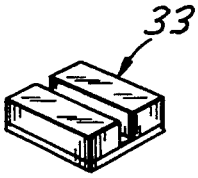
Figure 19:
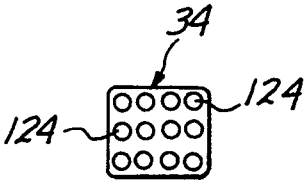

In FIG. 17 a pad **110*a* is shown that is a pliable sheet material that is made with transverse tubes covering the entire top of femoral blocks of previous figures. A smooth surfaced pad 110*b* with a non inflated middle section is shown in FIG. 18. In FIG. 19 an inflatable pad 110*c* is shown, that when inflated has a number of spaced bulbs 124** extending upwardly therefrom.

Figure 20:
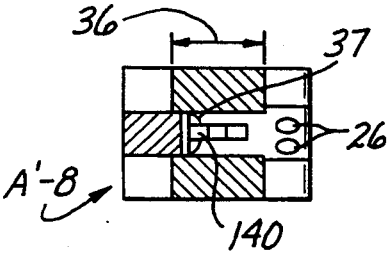
FIG. 20 is a top plan view of an alternate form of the eighth form of the invention.
Figure 21:
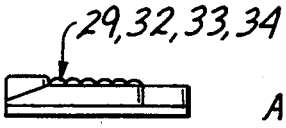
FIG. 21 is a side elevational view of the modular pad shown in FIG. 20.

An alternate form A'-8 of the eighth form A-8 of the invention is shown in FIG. 20, that is the same as the latter with the exception it includes a power operated pump 140 to inflate the pads 110, which pump may be actuated either manually or by completing an electric circuit thereto in conjunction with a power source and the pressure sensitive switches 100.

Figure 22:
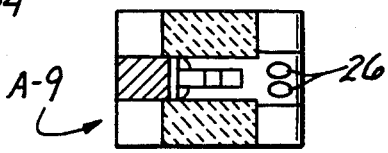
FIG. 22 is a top plan view of a ninth form of the invention.
Figure 23:
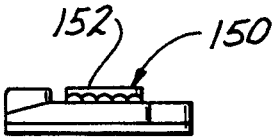
FIG. 23 is a side elevational view of the invention shown in FIG. 22.

A ninth form A-9 of the invention is shown in FIGS. 22 and 23 that is the same as the eighth form A-8 with the exception that is further includes two hollow resilient pads 150 filled with a gel, water or a viscous type of material 152. The pads 150 rest on the blocks 110 and are removably secured thereto by conventional means.

Figure 24:
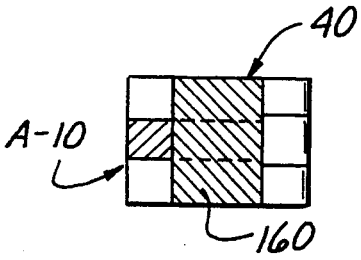
FIG. 24 is a top plan view of a tenth form of the invention.
Figure 25:
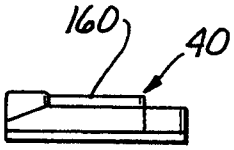
FIG. 25 is a side elevational view or the invention shown in FIG. 24.
Figure 26:
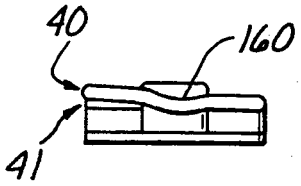
FIG. 26 is the same view as FIG. 25 but with the resilient supporting pad deformed by the weight of the patient, or where one side of the pad is denser or higher than the other.

A tenth form A-10 of the invention is shown in FIGS. 24 and 25 that is the same as the third form A-3 with the exception that a resilient pad 160 that may be hollow and filled with a viscous liquid or gel overlies both the blocks 42, 42' and may deform when subjected to the weight of a patient P as illustrated in FIG. 26. The blocks 42 and 42' may be of differing height and or different material to correct for pelvic tilt of the patient.

The use and operation of the various forms of the invention have been explained previously in detail and need not be repeated.

What is claimed is:

1. In a patient support system comprising a seat having a seating surface between a back and a front edge including a substantially upright back rest the improvement comprising:

a planar base having top and bottom surfaces between a forward end and a rear end and two side edges, said base being sized such that said forward end and said rear end lie between the back and the forward edge of said seating surface; and support means mounted on said upper surface, said support means defining a support plane elevated above said top surface and extending from said forward end to a termination approximately halfway between said forward and rear ends to define a rear area of said base devoid of said support means, said termination characterized by a substantially steep transition from said support plane to said upper surface, so as to support the thighs of said patient while seated on said seat above said upper surface of said base board while the buttocks are supported directly on said rear area of said base, whereby the user's pelvis is tilted in one direction with attendant correction in spinal column posture, said base being reversible on the seat for positioning said support means under the buttocks of the user while the knees are unsupported by said support means at the forward edge of the seat whereby the user's pelvis is tilted in an opposite direction with a corresponding correction in spinal column posture.

2. The pad of claim 1 wherein said base is substantially rigid.

3. The pad of claim 1 wherein said support means define a depression between said side edges for receiving the coccycal protuberance of the patient thereby to afford relief from pressure thereto.

4. The pad of claim 1 wherein said base is relatively pliable and said support means comprise inflatable means for defining said support plane, such that in a deflated condition of said support means said pad can be rolled to a compact configuration.

5. A method for determining corrected back posture of a seated patient, comprising the steps of:

providing a generally rectangular base board having top and bottom surfaces between a forward end and a rear end and two side edges, and femoral support means mounted on said upper surface, said support means defining a support plane elevated above said top surface and extending from said forward end to a termination approximately halfway between said forward and rear ends to define, said termination characterized by a substantially steep transition from said support plane to said upper surface;

positioning said board on a seat surface with said rear edge oriented towards the seat back and said transition just forward of the femoral head of the patient so as to support the thighs of a patient above said upper surface of said base board while the buttocks are supported directly on said board, whereby the patient's pelvis is tilted in one direction with attendant modification in spinal column posture; and reversing said board on said seat surface for positioning said support means under the buttocks of a user while the knees are unsupported above said base board whereby the patient's pelvis is tiled in an opposite direction with a corresponding opposite modification in spinal column posture.

6. A method for correcting back posture of a patient seated on a seating surface having a back and a front edge, comprising the steps of:

providing a flat seating surface having a generally upright back rest;

providing support means mounted on said surface, said support means defining a support plane elevated above said surface and extending from said front edge to a termination substantially spaced from said back and characterized by a substantially steep transition from said support plane to said upper surface, said termination being positioned just forward of the femoral head of the patient so as to support the thighs of the patient above said upper surface of said base board while the buttocks of the patient are supported directly on said surface, whereby the patient's pelvis is tilted towards said forward edge with attendant modification in spinal column posture.

7. A method for correcting back posture of a patient seated on a seating surface having a back and a front edge, comprising the steps of:

providing a flat seating surface having a generally upright back rest;

providing support means mounted on said surface, said support means defining a support plane elevated above said surface and extending from said back to a termination substantially spaced from said front edge and characterized by a substantially steep transition from said support plane to said upper surface, said support means being positioned under the buttocks of a user with said transition substantially spaced from said forward edge so that he patient's knees are unsupported above said surface whereby the patient's pelvis is tilted towards said back with a corresponding modification in spinal column posture.

* * * * *